United States Patent [19]

Bollig et al.

[11] 4,071,073

[45] Jan. 31, 1978

[54] CONTINUOUS CASTING ROLLER APRON WITH OVERHANG GUIDE RINGS

[75] Inventors: Georg Bollig, Sao Paulo-Santa Amaro, Brazil; Hans Streubel, Dusseldorf, Germany

[73] Assignee: Schloemann-Siemag Aktiengesellschaft, Dusseldorf, Germany

[21] Appl. No.: 601,720

[22] Filed: Aug. 4, 1975

[30] Foreign Application Priority Data

Aug. 16, 1974 Germany ..... 2439359

[51] Int. Cl.[2] ..... B22D 11/12

[52] U.S. Cl. ..... 164/448; 193/37

[58] Field of Search ..... 164/282; 193/35 R, 35 A, 193/35 SS, 35 C, 35 TE, 35 F, 35 MD, 35 J, 35 G, 35 B, 37; 226/189, 190, 194

[56] References Cited

U.S. PATENT DOCUMENTS

| | | | |
|---|---|---|---|
| 3,268,956 | 8/1966 | Lemper | 164/282 |
| 3,586,094 | 6/1971 | Machida | 164/282 |
| 3,768,614 | 10/1973 | Tabler | 193/37 |
| 3,812,900 | 5/1974 | Bollig et al. | 164/282 X |

*Primary Examiner*—Robert D. Baldwin
*Attorney, Agent, or Firm*—Werner W. Kleeman

[57] ABSTRACT

A roller apron framework or strand guide framework for supporting a partially solidified strand in a continuous casting installation, especially for casting slabs, comprising a number of rollers mounted within the maximum slab width. Guide rings are arranged in overhung position upon bearing journals provided for an intermediate portion of the guide rollers, the bearing journals protruding outwardly past the bearings of the rollers.

10 Claims, 2 Drawing Figures

CONTINUOUS CASTING ROLLER APRON WITH OVERHANG GUIDE RINGS

BACKGROUND OF THE INVENTION

The present invention relates to a new and improved roller apron framework or strand guide framework —hereinafter sometimes either conveniently referred to as a roller apron or roller apron framework— for supporting a partially solidified strand in a continuous casting installation, especially for the casting of slabs, comprising a plurality of rollers, especially guide rollers, mounted within the maximum slab width.

The guide rollers or rolls of continuous casting installations are exposed to high alternating mechanical loads during each revolution of the rollers owing to the ferrostatic pressure acting upon the strand shell or skin. In the case of continuous casting installations for the casting of slabs such high alternating mechanical loads can exceed one hundred tons for each roll. Further loading of the rolls occurs due to the shock-like temperature increase at the roll surface each time the same comes into contact with the hot strand. These mechanical and thermal loads, depending upon the strength of the material from which the rolls or rollers are fabricated, require a predetermined roll diameter.

The actually prevailing roll diameter of the rolls or rollers at a roller apron of a given continuous casting plant or installation governs the permissible minimum spacing between the rollers and equally the size of the unsupported surfaces of the strand between such rollers. The mutual dependency between the permissible roller load, the strand width, the thickness of the strand shell or skin, the roller diameter and the spacing between successive rollers, limits the casting speed during the continuous casting of large casting formats or shapes, since there must be prevented damaging bowing-out or dishing of the strand and metal breakouts. Hence, strands having a width of, for instance, 2.5 to 3 meters can not be rationally cast with the heretofore known continuous casting installations.

There is already known to the art a roller apron framework wherein the shafts mounted a number of times in a support arrangement are disposed in each case between the bearings of short guide roller sections. Consequently, it is possible to maintain relatively small the spacing between successive guide rollers in the direction of travel of the strand. This roller apron is complicated due to the numerous bearings and roller sections. Since the rollers only can be disassembled together with their supporting framework each time it is necessary in a cumbersome and time-consuming manner to disconnect the attachment or fastening devices of the supporting framework. Moreover, the bearings themselves are extremely poorly accessible for maintenance and servicing work. Hence, this state-of-the-art roller apron framework or roller apron does not fulfill the requirements for a simple construction conducive to repair work.

SUMMARY OF THE INVENTION

With the foregoing in mind, it is a primary object of the present invention to provide a new and improved construction of a roller apron framework for a continuous casting installation which is not associated with the aforementioned drawbacks and limitations of the prior art constructions.

Another and more specific object of the present invention resides in the provision of a relatively simple, robust roller apron framework for continously cast strands, especially slabs, wherein, with acceptable roller loads, it is possible to maintain the unsupported surfaces between the rolls or rollers small in order to be able to cast strands, especially wide slabs at high casting speeds while preventing dishing- or bowing-out of such wide slabs.

Now in order to implement these and still further objects of the invention, which will become more readily apparent as the description proceeds, the roller apron framework of the present invention is manifested by the features that guide rings are arranged in an overhung cantilever position at bearing journals of an intermediate part or portion of the guide rollers or rolls, these bearing journals protruding outwardly past the roller bearings. The reduction of the bearing spacing which is realized in this manner renders possible the use of thinner guide rollers and thus a reduction in the spacing between successive guide rollers and hence a reduction in the size of the unsupported surfaces of the cast strand. Consequently, it is also possible to cast slabs having a width exceeding 2.5 meters with economical production speeds. A further advantageous feature of the invention resides in the fact that the loaded guide rings exert a restoring moment upon the intermediate or central portion of the guide rollers and therefore prevent through-bending thereof. When roller fractures occur individual guide rollers can be rapidly exchanged in the axial direction without having to simultaneously dismantle the supporting framework. Both of the bearings are easily accessible after removal of the guide rings. The guide rollers can be driven by means of the extended bearing journals. A particularly advantageous constructional manifestation of the invention contemplates a double-mounting of the guide rollers.

According to a further aspect of the invention the spacing between the centers of the bearings of the guide rollers amounts to at least fifty (50%) percent of the maximum slab width. As a result, it is possible to realize an optimum distribution of the bending loads over the roller- and journal cross-section. In order to prevent that during the conveying of the slab or the like there always remains unsupported the same region of the slab due to the position of the bearings of the rollers, the bearings of successive guide rollers can be arranged to be mutally offset. It also can be advantageous to provide successive guide rollers in each case at alternate sides with a respective guide ring or ring member.

In order to drive the guide rollers the extended bearing journals of the guide rollers can be operatively connected via a coupling or equivalent structure with a drive shaft.

Further, the guide rings can be provided with guide means for a coolant, typically cooling water, such cooling water guide means or guides can be constituted, for instance by channels, bores or equivalent structure, and advantageously are connected to an infeed or supply means provided in the journals.

It is to be appreciated that the teachings of the invention have utility for rollers arranged at the guide region as well as rollers arranged at the straightening region or zone of a continuous casting installation, and thus the term "guide rolls or rollers" as employed herein in used in a broader sense to encompass at least these various possibilities.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
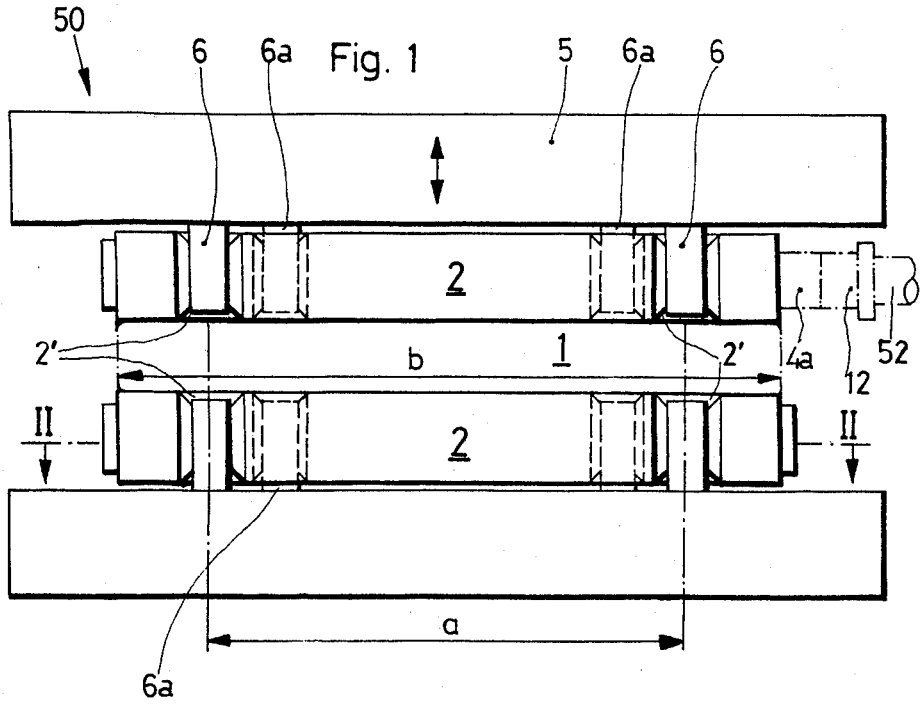
FIG. 1 schematically illustrates a pair of guide rollers or rolls of a continuous casting installation which are mounted at traverses or transversely extending roller support members.

Describing now the drawing, it is to be understood that only enough of the structure of the continuous casting installation has been illustrated to enable those skilled in the art to readily understand the underlying concepts of this development. Hence, it will be recognized that at a roller apron framework, generally designated by reference character 50, of a continuous casting plant or installation for the casting of strands, especially slabs 1, cooperating pairs of rolls or rollers 2, here assumed to be guide rollers, are arranged in succession in spaced relationship from one another as is well known in this art, for instance as shown in U.S. Pat. No. 3,867,827, granted Feb. 25, 1975. Hence, to preserve clarity in illustration the next pair of spaced guide rollers following the guide rollers 2 have been merely schematically indicated in partial outline by reference character 2' in FIG. 1. To simplify the description of the invention the discussion to follow will be made with reference to the full line shown guide rollers 2, but the principles of the invention are equally applicable to the other rollers of the roller apron frame-work 50.

Each guide roller or roll 2 comprises an intermediate or central portion 3 provided with the outwardly protruding bearing journals 4 or equivalent structure at opposed ends of such roller. These bearing journals 4 are rotatably guided in suitable bearings 6 secured to the associated traverse or transversely extending roller support 5. The bearing housing 6' of each bearing 6 which is connected in any suitable manner with the associated traverse 5 is advantageously provided with a compartment or chamber 7 for a coolant, typically water, and such bearing housing 6' seats therein the roller bearings 8. On to the bearing journals 4 which are extended past the bearings 6 there are pushed guide rings or guide ring members 9 which are held in desired position by means of suitable fixing plates or discs 10 or the like threadably connected with or otherwise suitably affixed at the end face 4' of the associated bearing journal 4. In order to secure each of the guide rings 9 against rotation there are provided the hammered-in bolts 11 or equivalent structure.

Continuing, it is to be appreciated that the spacing or distance *a* of the centers of the oppositely situated and spaced bearings 6 of each of the guide rollers or rolls 2 amounts to at least fifty (50%) percent of the maximum slab width *b*.

In the event that the guide rollers 2 should be driven, then as schematically indicated in FIG. 1, a suitable coupling or coupling means 12 can be mounted at an extended bearing journal, as indicated by reference character **4*a* in FIG. 1, this coupling means 12 being operatively associated with the schematically shown drive shaft 52**.

Figure 2:
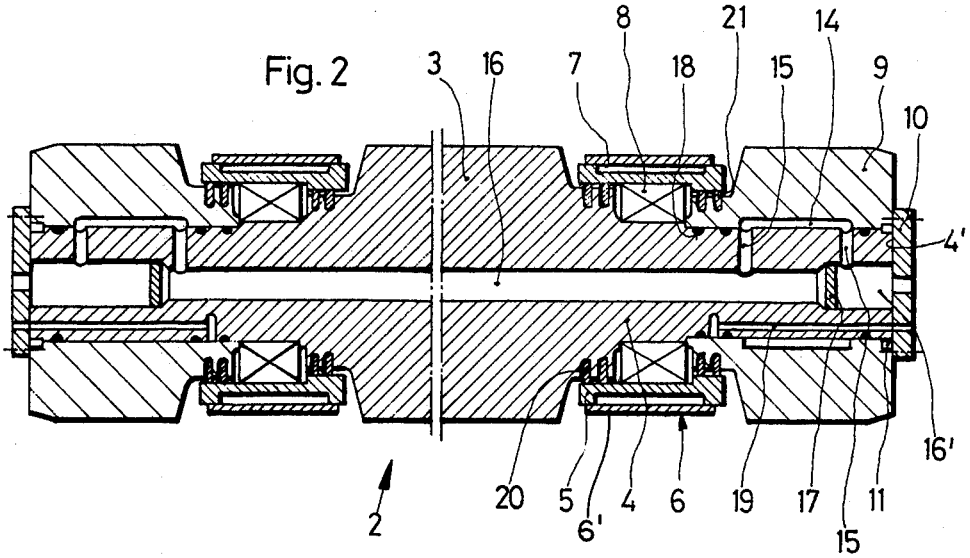
FIG. 2 is an enlarged cross-sectional view relative to the showing of FIG. 1 through one of the guide rollers depicted in the arrangement of FIG. 1.

The guide rings 9 are each provided with coolant guide means which may comprise a machined or otherwise suitably formed portion forming channel or recess means 14 at the inside thereof for guiding the cooling water, such channel means 14 being flow connected with a coaxially extending cooling water conduit or passageway 16 extending through the roller 3, as best seen by referring to FIG. 2, by means of radial bores 15 provided in the journals 4 and which radial bores are offset with respect to one another through an angle of about 180°. By means of a disc 17 arranged at each end region or portion 16' of the cooling water conduit 16 the cooling water or other cooling agent can be conducted through the channels or channel means 14.

In order to prevent cooling water from escaping out of the channels 14 into the bearing housing 6' a relief bore or passageway 19 or equivalent structure is provided between two sealing O-rings 18 at each end of the roller 2. Each bearing housing 6' is sealed by piston rings 20, 21 or other suitable seals with respect to the intermediate or central portion 3 of the roller 2 and the neighboring guide ring or ring member 9.

Other modifications from the exemplary embodiment discussed above are of course contemplated and possible and within the teachings of the present invention. Thus, it would be possible to have the bearings of successive guide rollers, such as the guide rollers 2 and 2' mutually offset with respect to one another, as indicated for instance at the left-hand portion of FIG. 1, wherein it will be seen that the bearing 6 of the topmost guide roller 2 is offset with respect to the schematically indicated bearing **6*a* shown in phantom lines of the next following upper guide roller 2'. A similar offset relationship of the bearings at the other end of such rollers and equally the bottom rollers could be provided. Moreover, it is not absolutely necessary in all instances to provide a guide ring 9 at each end of each roller, rather it is conceivable to have an arrangement wherein, for instance, each of the guide rollers 2 has a guide ring 9 only at one end thereof and then the next following guide rollers 2' each have such guide ring mounted at the opposite end, so that there is provided a successive alternate or staggered arrangement of the guide rings from one roller to the next following roller along the successively arranged bank of guide rollers. Moreover, each guide roller may possess no more than two spaced bearings, as shown in the arrangement of FIG. 1**, so that there is provided for each such guide roller a so-called double-mounting or bearing arrangement.

While there are shown and described present preferred embodiments of the invention, it is to be distinctly understood that the invention is not limited thereto, but may be otherwise variously embodied and practiced within the scope of the following claims. ACCORDINGLY,

We claim:

1. A roller apron framework for supporting a partially solidified strand on two opposite sides of the strand in a continuous casting installation, especially for the casting of slabs, comprising a plurality of cooperating pairs of rollers, means for mounting each of said rollers within a maximum slab supporting width, each said roller comprising an intermediate strand supporting portion and bearing journals extending outwardly of said intermediate strand supporting portion, said roller mounting means including support means arranged on said opposite sides of the strand for supporting the rollers and a bearing provided for each bearing journal for connecting the rollers to their associated support means, each bearing being mounted at its associated support means within the maximum slab supporting width, each bearing journal of each roller extending outwardly past the bearing thereof, and a guide ring for supporting the strand arranged in an overhang fashion at least at one bearing journal of each roller.

2. The roller apron framework as defined in claim 1, wherein said rollers comprise guide rollers.

3. The roller apron framework as defined in claim 2, wherein each roller is provided with a maximum of two bearings for providing a double-mounting arrangement for each roller.

4. The roller apron framework as defined in claim 3, wherein a guide ring for supporting the strand and arranged in an overhang fashion is provided at each bearing journal of each roller.

5. The roller apron framework as defined in claim 4, wherein the spacing between centers of the bearings provided at the bearing journals of each guide roller amounts to at least fifty percent of the maximum slab supporting width.

6. The roller apron framework as defined in claim 2, wherein the bearings of successive guide rollers are offset with respect to one another.

7. The roller apron framework as defined in claim 2, wherein successive guide rollers are provided at alternate sides with respective ones of said guide rings.

8. The roller apron framework as defined in claim 2, further including a drive shaft, coupling means for coupling an outwardly extending bearing journal of at least one guide roller with said drive shaft.

9. The roller apron framework as defined in claim 2, wherein each of the bearings of the guide rollers are provided with cooling means.

10. The roller apron framework as defined in claim 2, wherein means defining guide means for a coolant are provided for each of the guide rings.

* * * * *